US010109188B2

(12) United States Patent
Dauneria

(10) Patent No.: US 10,109,188 B2
(45) Date of Patent: Oct. 23, 2018

(54) METHOD, ALERT CONTROL DEVICE, STREET LIGHT, COMPUTER PROGRAM AND COMPUTER PROGRAM PRODUCT FOR ALERTING TRAFFIC

(71) Applicant: TELEFONAKTIEBOLAGET L M ERICSSON (PUBL), Stockholm (SE)

(72) Inventor: Ankur Dauneria, New Delhi (IN)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 106 days.

(21) Appl. No.: 14/906,763

(22) PCT Filed: Jul. 26, 2013

(86) PCT No.: PCT/SE2013/050931

§ 371 (c)(1),
(2) Date: Jan. 21, 2016

(87) PCT Pub. No.: WO2015/012749

PCT Pub. Date: Jan. 29, 2015

(65) Prior Publication Data

US 2016/0163194 A1 Jun. 9, 2016

(51) Int. Cl.
*G08G 1/087* (2006.01)
*G08G 1/07* (2006.01)

(52) U.S. Cl.
CPC ..... *G08G 1/087* (2013.01); *G08G 1/07* (2013.01)

(58) Field of Classification Search
None
See application file for complete search history.

(56) References Cited

U.S. PATENT DOCUMENTS 5,559,509 A * 9/1996 Ogle ..... G08G 1/005 116/63 R
5,806,965 A * 9/1998 Deese ..... H05B 33/0803 362/237
6,040,774 A * 3/2000 Schepps ..... G01S 13/74 340/12.54

(Continued)

FOREIGN PATENT DOCUMENTS

WO 2012/160243 A1 11/2012

OTHER PUBLICATIONS

World Health Organization, "Road traffic injuries: Fact Sheet No. 358," Mar. 2013, 4 pages, http://www.who.int/mediacentre/factsheets/fs358/en/.

(Continued)

*Primary Examiner* — Curtis King
*Assistant Examiner* — Chico A Foxx
(74) *Attorney, Agent, or Firm* — Rothwell, Figg, Ernst & Manbeck, P.C.

(57) ABSTRACT

It is provided a method for alerting traffic. The method is performed in an alert control device connected to a street light and comprises the steps of: detecting the presence of a radio frequency identification device using a radio frequency identification reader; and controlling the street light to go from a normal state to an alert state, wherein the lighting of the street light in the alert state differs from the lighting of the street light in the normal state. Alert control devices, a street light, a computer program and a computer program are also presented.

23 Claims, 4 Drawing Sheets

(56) References Cited

U.S. PATENT DOCUMENTS 6,650,242 B2 * 11/2003 Clerk ..... F16P 3/144 340/425.5
7,688,222 B2 * 3/2010 Peddie ..... G08G 1/096783 116/63 P
7,787,648 B1 * 8/2010 Frerking ..... H04R 25/50 381/317
8,860,577 B1 * 10/2014 Chumas ..... A01M 31/004 248/127
2003/0052161 A1 * 3/2003 Rakers ..... G06K 19/0723 235/375
2005/0073437 A1 * 4/2005 Perri ..... G08G 1/005 340/944
2008/0042878 A1 * 2/2008 Heng ..... G08G 1/005 340/936
2010/0049359 A1 * 2/2010 Allen, Jr. ..... B65G 51/32 700/218
2010/0073194 A1 * 3/2010 Ghazarian ..... G08G 1/017 340/901
2010/0295943 A1 * 11/2010 Cha ..... G01S 13/82 348/143
2010/0296285 A1 11/2010 Chemel et al.
2011/0133655 A1 * 6/2011 Recker ..... H02J 9/02 315/159
2011/0265154 A1 * 10/2011 Furlan ..... H04L 12/2809 726/5
2012/0056720 A1 * 3/2012 Barvick ..... G06K 7/10009 340/10.1
2012/0062123 A1 * 3/2012 Jarrell ..... H05B 37/0245 315/131
2012/0143356 A1 * 6/2012 Berg-Sonne ..... G05B 15/02 700/49
2012/0329389 A1 * 12/2012 Royston ..... H04B 5/0062 455/41.1
2013/0278146 A1 * 10/2013 Wilsher ..... H05B 37/02 315/151
2013/0337789 A1 * 12/2013 Johnson ..... H04W 4/02 455/414.1
2014/0106669 A1 * 4/2014 Krishnan ..... H04B 5/00 455/41.1
2014/0211487 A1 * 7/2014 Spiro ..... F21V 23/06 362/382
2014/0218186 A1 * 8/2014 Kawamoto ..... G01S 13/04 340/426.1
2014/0369058 A1 * 12/2014 Foltin ..... B60Q 1/085 362/466
2015/0173156 A1 * 6/2015 Pedersen ..... H05B 37/0272 315/151
2015/0264776 A1 * 9/2015 Amarin ..... G06Q 10/0875 315/129
2016/0151231 A1 * 6/2016 Villar Cloquell .... G09B 21/001 340/944
2017/0005717 A1 * 1/2017 Berry ..... G01S 1/68

OTHER PUBLICATIONS

International Search Report issued in corresponding International application No. PCT/SE2013/050931, dated Mar. 31, 2014, 3 pages.
International Preliminary Report on Patentability issued in corresponding International application No. PCT/SE2013/050931, dated Jan. 26, 2016, 9 pages.
European Office Action dated Aug. 27, 2018 issued in European Patent Application No. 13 745 918.6 (10 pages).

* cited by examiner

METHOD, ALERT CONTROL DEVICE, STREET LIGHT, COMPUTER PROGRAM AND COMPUTER PROGRAM PRODUCT FOR ALERTING TRAFFIC

CROSS REFERENCE TO RELATED APPLICATION(S)

This application is a 35 U.S.C. § 371 National Phase Entry Application from PCT/SE2013/050931, filed Jul. 26, 2013, designating the United States, the disclosure of which is incorporated by reference.

TECHNICAL FIELD

The invention relates to alerting traffic by altering the state of a street light.

BACKGROUND

Road accidents are a serious problem affecting people worldwide. In March 2013, the World Health Organisation published a report (available at http://www.who.int/media-centre/factsheets/fs358/en/ at the time of filing this application) on road accidents, concluding several alarming facts:

- About 1.24 million people die each year as a result of road traffic crashes.
- Road traffic injuries are the leading cause of death among young people, aged 15-29 years.
- 91% of the world's fatalities on the roads occur in low-income and middle-income countries, even though these countries have approximately half of the world's vehicles.
- Half of those dying on the world's roads are "vulnerable road users": pedestrians, cyclists and motorcyclists.
- Without action, road traffic crashes are predicted to result in the deaths of around 1.9 million people annually by 2020.
- Only 28 countries, representing 416 million people (7% of the world's population), have adequate laws that address all five risk factors (speed, drink-driving, helmets, seat-belts and child restraints).

Main causes of road accidents have been concluded to relate to speed, drink-driving, lack of helmet use, lack of use of seat belts and child restraints and distracted driving. Focusing on speed and distracted driving, the WHO have published their findings as follows.

Regarding speed, it has been found that an increase in average speed is directly related both to the likelihood of a crash occurring and to the severity of the consequences of the crash.

Regarding distracted driving, there are many types of distractions that can lead to impaired driving, but recently there has been a marked increase around the world in the use of mobile phones by drivers that is becoming a growing concern for road safety. The distraction caused by mobile phones can impair driving performance in a number of ways, e.g. longer reaction times, impaired ability to keep in the correct lane, and shorter following distances. Text messaging also results in considerably reduced driving performance, with young drivers at particular risk of the effects of distraction resulting from this use. A driver using a mobile phone is approximately four times more likely to be involved in a crash than when a driver does not use a mobile phone. Hands-free phones are not much safer than hand-held phone sets. While there is little concrete evidence yet on how to reduce mobile phone use while driving, governments need to be proactive. Actions that can be taken include adopting legislative measures, launching public awareness campaigns, and regularly collecting data on distracted driving to better understand the nature of this problem.

Drivers can also be distracted by other devices, such as GPS (Global Positioning System) receivers, video players and other infotainment devices.

In light of latest facts on road safety, a key problem is the vulnerability of unprotected road users such as pedestrians and cyclists. It would be greatly beneficial if there was an efficient way to alert traffic of unprotected road users to reduce the risk of accidents.

The use of street lights helps drivers to see unprotected road users but distracted drivers may still not be alert enough to notice the unprotected road users.

Traffic lights can be used to stop traffic e.g. when unprotected road users need to cross the road. However, traffic lights are expensive and can not be installed everywhere there are pedestrians and cyclists, particularly in low and middle income countries.

SUMMARY

It is an object to provide a way to alert traffic of an unprotected road user.

According to a first aspect, it is provided a method for alerting traffic. The method is performed in an alert control device connected to a street light and comprises the steps of: detecting the presence of a radio frequency identification (RFID) device using a radio frequency identification reader; and controlling the street light to go from a normal state to an alert state, wherein the lighting of the street light in the alert state differs from the lighting of the street light in the normal state. In this way, when a user carrying an RFID device approaches alert control device connected to a street light, any vehicles in the road are clearly alerted of the presence of the user, reducing the risk of a vehicle hitting the user, e.g. when the user needs to cross the road. Significantly, there can be many street lights with associated alert control devices, whereby each street light/alert control device combination can be atomic and does not need to be connected to any other controller for operation, even if this is also possible. This greatly simplifies deployment and cost, e.g. compared to deploying traffic lights which are typically also only provided at intersections; alerting street lights can be deployed at arbitrary locations along a road where unprotected road users are frequent. Moreover, compared to traffic lights, this solution does not command traffic to stop, which is less obtrusive to traffic and can thus increase acceptance of this solution.

The step of detecting may comprise detecting a radio frequency identification device with an identifier being within a predefined range. This allows the definition of a specific set of RFID devices which are to trigger the alert state of the street light.

In the step of controlling, the alert state may involve an altered colour compared to the normal state.

In the step of controlling, the alert state may involve an altered light intensity compared to the normal state. This is another way of alerting drivers without the need of having a street light with alterable colour.

The method may further comprise the steps of: detecting an absence of any radio frequency identification devices using the radio frequency identification reader; and controlling the street light to go from the alert state to the normal state. In other words, the street light then returns to the normal state when the RFID device is not in range anymore.

The step of detecting an absence of any radio frequency identification devices may comprise detecting an absence of any radio frequency identification devices during a configurable time period. This can prevent the street light from returning to normal state when the user carrying the RFID device is still on the road but outside a detection range of the alert control device.

The alert control device may be connected to two street lights on either side of a road in which case the step of controlling the street light controls both street lights the same way. This makes crossing a road safer, since the alert to traffic is even more noticeable.

The step of detecting the presence of a radio frequency identification device may comprise detecting, using a near field communication (NFC) reader, the presence of a radio frequency identification device comprised in a near field communication compliant wireless communication device. NFC communication typically requires a distance of 10 cm or less and works at 13.56 MHz frequency. This short distance can be used to detect intent, distinguishing between users which are present by a street light and users intending to enter the road, e.g. to cross the road.

The step of detecting the presence of a radio frequency identification device may comprise detecting the presence of a battery powered radio frequency identification device which is activated by a user. This is another way of a user being able to indicate an intent to enter the road.

The method may further comprise the step of: storing log data regarding when the step of controlling the street light to go from a normal state to an alert state has occurred. The log data can be used to analyse patterns of usage, which then serves as an indicator of unprotected road user presence.

According to a second aspect, it is provided an alert control device for alerting traffic. The alert control device is arranged to be connected to a street light, and the alert control device comprises: a processor; and a memory storing instructions that, when executed by the processor, causes the alert control device to: detect a presence of a radio frequency identification device using a radio frequency identification reader; and control the street light to go from a normal state to an alert state, wherein the lighting of the street light in the alert state differs from the lighting of the street light in the normal state.

The instructions to detect may comprise instructions that, when executed by the processor, causes the alert control device to detect a radio frequency identification device with an identifier being within a predefined range.

The alert state may involve an altered colour compared to the normal state.

The alert state may involve an altered light intensity compared to the normal state.

The alert control device may further comprise instructions that, when executed by the processor, causes the alert control device to: detect an absence of any radio frequency identification devices using the radio frequency identification reader; and control the street light to go from the alert state to the normal state.

The instructions to detect an absence of any radio frequency identification devices may comprise instructions that, when executed by the processor, causes the alert control device to detect an absence of any radio frequency identification devices during a configurable time period.

The alert control device may be connected to two street lights on either side of a road in which case the alert control device is arranged to control both street lights the same way.

The instructions to of detect the presence of a radio frequency identification device may comprise instructions that, when executed by the processor, causes the alert control device to detect, using a near field communication reader, the presence of a radio frequency identification device comprised in a near field communication compliant wireless communication device.

The instructions to detect the presence of a radio frequency identification device may comprise instructions that, when executed by the processor, causes the alert control device to detect the presence of a battery powered radio frequency identification device which is activated by a user.

The alert control device may further comprise instructions that, when executed by the processor, causes the alert control device to: store log data regarding when the street light is controlled to go from a normal state to an alert state has occurred.

According to a third aspect, it is provided an alert control device comprising means for detecting the presence of a radio frequency identification device using a radio frequency identification reader; and controlling a street light, connected to the alert control device, to go from a normal state to an alert state, wherein the lighting of the street light in the alert state differs from the lighting of the street light in the normal state.

The means for detecting may comprise means for detecting a radio frequency identification device with an identifier being within a predefined range.

The alert state may involve an altered colour compared to the normal state.

The alert state may involve an altered light intensity compared to the normal state.

The alert control device may further comprise means for detecting an absence of any radio frequency identification devices using the radio frequency identification reader; and means for controlling the street light to go from the alert state to the normal state.

The means for detecting an absence of any radio frequency identification devices may means for detecting an absence of any radio frequency identification devices during a configurable time period.

The alert control device may be connected to two street lights on either side of a road in which case the means for of controlling the street light comprises means for controlling both street lights the same way.

The means for detecting the presence of a radio frequency identification device may comprise means for detecting, using a near field communication reader, the presence of a radio frequency identification device comprised in a near field communication compliant wireless communication device.

The means for detecting the presence of a radio frequency identification device may comprise means for detecting the presence of a battery powered radio frequency identification device which is activated by a user.

The alert control device may further comprise means for storing log data regarding when controlling the street light to go from a normal state to an alert state has occurred.

According to a fourth aspect, it is provided a street light comprising the alert control device according to the second aspect or the third aspect.

According to a fifth aspect, it is provided a computer program comprising computer program code. The computer program code, when run on a alert control device connected to a street light, causes the alert control device to: detect a presence of a radio frequency identification device using a radio frequency identification reader; and control the street light to go from a normal state to an alert state, wherein the lighting of the street light in the alert state differs from the lighting of the street light in the normal state.

According to a sixth aspect, it is provided a computer program product comprising a computer program according to the fifth aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
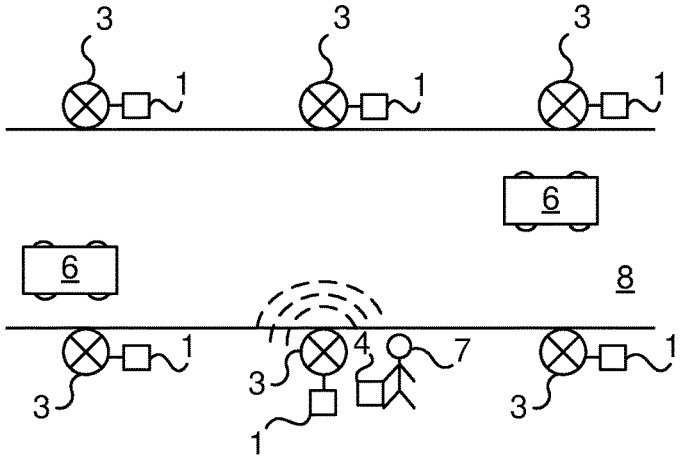
FIG. 1 is a schematic diagram illustrating alerting traffic according to one embodiment.

FIG. 1 is a schematic diagram illustrating alerting traffic according to one embodiment. There is a road 8 where vehicles 6 can drive. On one or both sides of the road 8, there are street lights 3. Each street light 3 has an associated (internal or external) alert control device 1. A user 7 carries a radio frequency identification (RFID) device 4. The user 7 is an unprotected road user, such as a pedestrian or cyclist.

The RFID device can e.g. be an RFID tag embodied in daily usage items. RFID tags can be produced at very low unit cost. For example, the user 7 can carry an RFID tag being part, or attached to a wireless communication device (such as a mobile communication terminal, smartphone, tablet computer or similar), a case or cover of a wireless communication device, belt, walking stick, laptop bag, ladies purse, belt or chain of pet dog, pram, portable audio media player, bicycle seat, bicycle light, watch, clothing, shoes, etc.

When the alert control device 1 of a street light 3 detects the presence of the RFID device 4, the alert control device controls the street light 3 to go from a normal state to an alert state, e.g. by changing colour and/or intensity, as indicated by the dashed lines by the street light 3 in the middle on the lower side of the road 8 in FIG. 1.

In this way, when the user 7 carrying the RFID device 4 approaches a street light 3, the vehicles 6 are clearly alerted of the presence of the user, reducing the risk of a vehicle 6 hitting the user 7, e.g. when the user needs to cross the road. Significantly, each street light 3/alert control device 1 combination can be atomic and does not need to be connected to any other controller for operation, even if this is also possible. This greatly simplifies deployment and cost, e.g. compared to deploying traffic lights which are typically also only provided at intersections; alerting street lights can be deployed at arbitrary locations along a road where unprotected road users are frequent. Moreover, compared to traffic lights, this solution does not command traffic to stop, which is less obtrusive to traffic and can thus increase acceptance of this solution. Also, the use of street lights is greatly effective in alerting traffic, since the driver is clearly made aware of the user 7.

If a cyclist rides a bike along the road 8 carrying an RFID device 4, alert control devices 1 by street lights will detect the RFID device as it moves along, alerting traffic of the presence of the cyclist.

Figure 2:
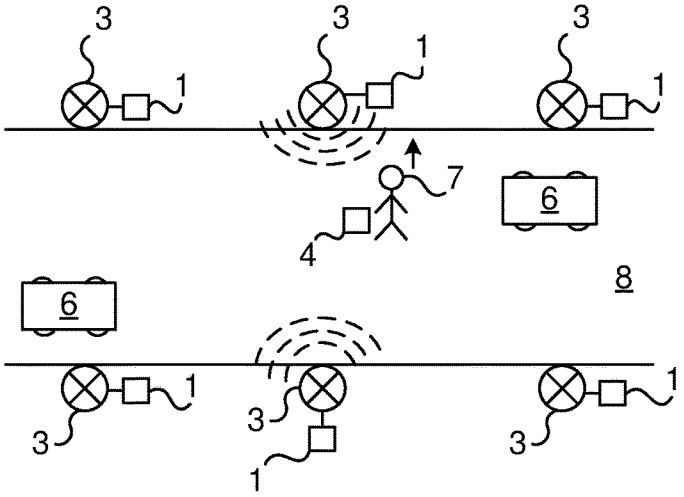
FIG. 2 is a schematic diagram illustrating alerting traffic according to one embodiment when an unprotected road user crosses the road.

FIG. 2 is a schematic diagram illustrating alerting traffic according to one embodiment when an unprotected road user crosses the road. Here, compared to the situation shown in FIG. 1, the user 7 is in the process of crossing the road 8 and is approaching the top middle street light 3 and its alert control device 1, whereby the top middle street light 3 is controlled to go into the alert state, further indicating to traffic that there is an unprotected road user.

When the RFID device 4 is out of range of the alert control device 1, the street light 3 is controlled by the alert control device 1 to return to the normal state. Optionally, the return to normal state only occurs after a configurable time period after the RFID device 4 is out of range to prevent the street light 3 from returning to normal state when the user 7 is still on the road but outside a detection range of the alert control device 1.

Figure 3:
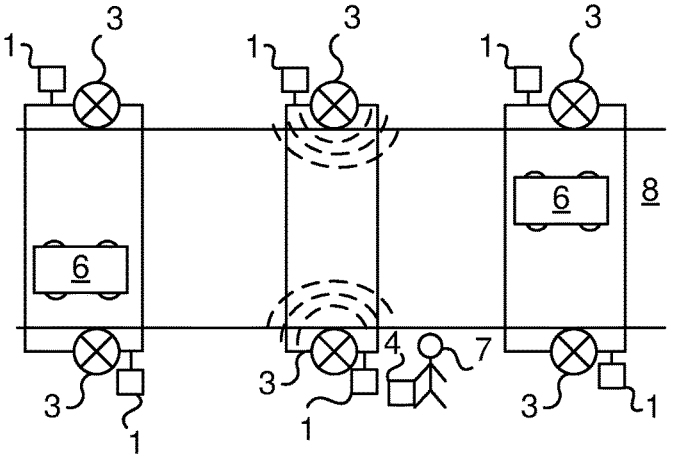
FIG. 3 is a schematic diagram illustrating alerting traffic according to one embodiment where street lights opposite each other are connected.

FIG. 3 is a schematic diagram illustrating alerting traffic according to one embodiment where street lights opposite each other are connected to the same alert control device(s) 1. In this way, street lights 3 across from each other are controlled synchronously to better alert traffic of the presence of an unprotected road user.

Figure 4:
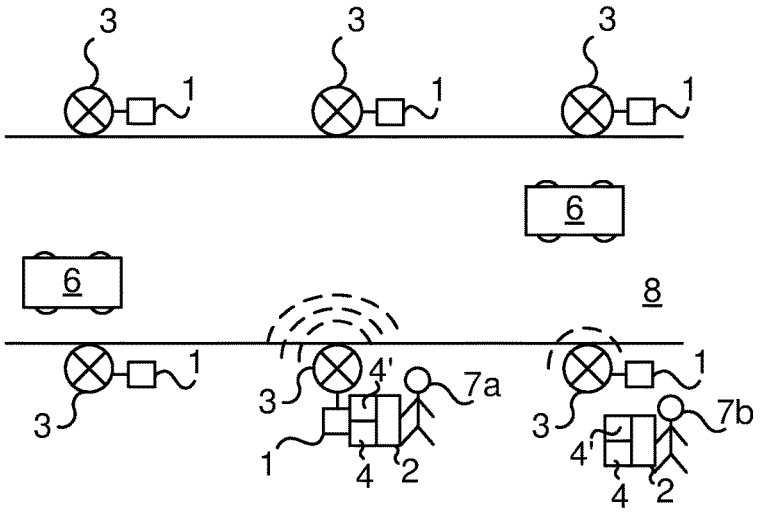
FIG. 4 is a schematic diagram illustrating alerting traffic according to one embodiment where near field communication (NFC) is used.

FIG. 4 is a schematic diagram illustrating alerting traffic according to one embodiment where NFC is used. The alert control device 1 here comprises an NFC reader. NFC is commonly used for contactless short-range communications based on radio frequency identification (RFID) standards, using magnetic field induction to enable communication between electronic devices, including wireless communication devices. This short-range high frequency wireless communications technology exchanges data between devices over a short distance, such as only a few centimeters. NFC communication typically requires a distance of 10 cm or less and works at 13.56 MHz frequency. This short distance can be used to detect intent, distinguishing between users which are present by a street light and users intending to enter the road, e.g. to cross the road.

For example, a first user 7*a* and a second user 7*b* each carries a wireless communication device 2 (such as a mobile communication terminal, smartphone, tablet computer or similar) which comprises an NFC device 4' which thus is an RFID device. In other words, the wireless communication device 2 is NFC compliant. Here the presence of a user 7*a-b* is only detected by detecting the presence of the NFC device 2 due to a user action, e.g. by tapping the NFC device on the alert control device 1. Hence, the first user 7*a*, tapping the NFC device 2 on the alert control device 1 causes the connected street light 3 to go into the alert state. However, the second user 7*b*, while being in the proximity of another alert control device 1, does not cause the street light 3 connected to the other alert control device 1 to go into an alert state.

The user action of the NFC device differentiates users actually intending to cross the road from users which are only by the side of the road but have no intent of crossing the road. This reduces the number of unnecessary alerts due to users being close to the alert control device 1, whereby the alerts only relate to users with the intent to alert traffic, e.g. for crossing the road or having to go into the road for other reasons.

Optionally, the wireless device 2 is an NFC device and also comprises a separate RFID tag 4, being part of or attached to the wireless device 2. In that way, the alert control device 1 can distinguish between user presence and user intent. In one embodiment, the alert control device 1 is arranged to alert, using the connected street light in different ways when there is only user presence and no user intent, compared to when there is user intent (and optionally also user presence). For example, looking to FIG. 4, the middle lower traffic light 3, where the connected alert control device 1 detects intent to enter the road 8 by the first user, can be controlled to have a more intense light or different colour compared to the lower right traffic light 3, where only a presence of the second user 7*b* is detected.

The alert control devices 1 are able to distinguish between an NFC device 4' and an RFID tag 4. In one embodiment, this can be achieved by the alert control device comprising an RFID reader and an NFC reader, which work on different frequencies. For example, at the time of filing this patent application, NFC only works over 13.56 MHz, while RFID have multiple frequencies on which it can operate. Alternatively or additionally, the identifiers for the NFC devices and RFID tags are within different predefined ranges allow distinction between NFC devices and RFID tags.

Figure 5A:
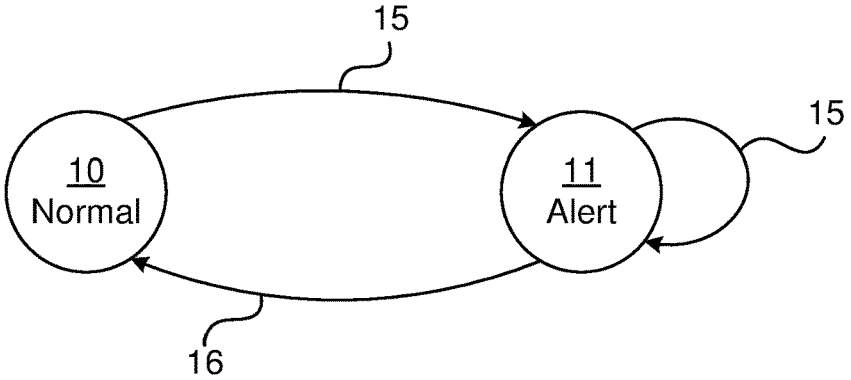
FIGS. 5A-B are state diagrams illustrating the operation of the street light of FIGS. 1-4.
Figure 5B:
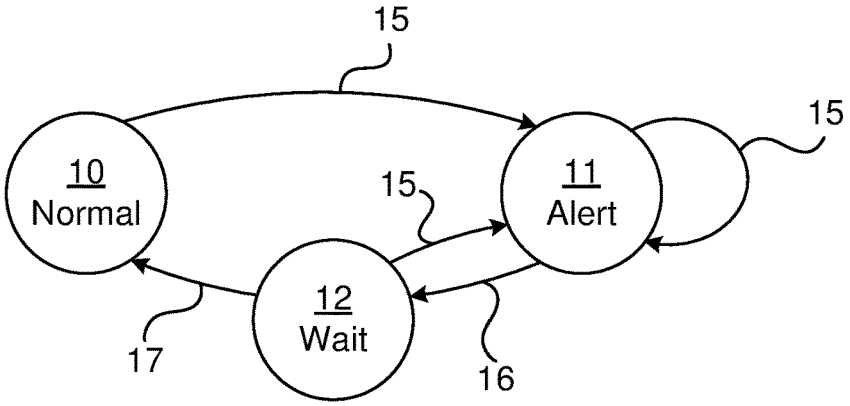

FIGS. 5A-B are state diagrams illustrating the operation of any one of the street lights 3 of FIGS. 1-4. First, the state diagram shown in FIG. 5A will be described.

In the normal state 10, the traffic light operates as normal, lighting the road and optionally roadside by the street light. When in the normal state 10, the street light transitions to the alert state 11 when an RFID device is detected 15 by a connected alert control device.

In the alert state 11, the lighting of the street light differs from the lighting of the street light in the normal state 10. In one embodiment, in the alert state 11, the street light shines with a different colour than when in the normal state 10. Alternatively or additionally, the alert state 11 involves an altered light intensity compared to the normal state 10. The altered light intensity can e.g. be that the street light shines brighter or that the light intensity varies over time, e.g. by blinking. Alternatively or additionally, the altered light intensity can comprise that the street light is on at daytime, compared to being off in the normal state 10.

When in the alert state 11, the street light transitions to the normal state 10 when the absence of an RFID device is detected 16 by the connected alert control device. If a new RFID device is detected 15 by the connected alert control device, the street light is controlled to stay in the alert state 11.

Looking now to the state diagram of FIG. 5B, there is here also a wait state 12. When in the alert state 11, the street light transitions to the wait state 12 when the absence of an RFID device is detected 16 by the connected alert control device. In the wait state 12, when a timer expires 17, the street light transitions to the normal state 10. On the other hand, when in the wait state 12, if an RFID device is detected 15 by the connected alert control device, the street light is controlled to return to the alert state 11.

Using the wait state 12, the risk of prematurely returning to the normal state 10 from the alert state 11 is reduced, e.g. if the user is still in the road but outside the detection range of any alert control devices 1.

Figure 6A:
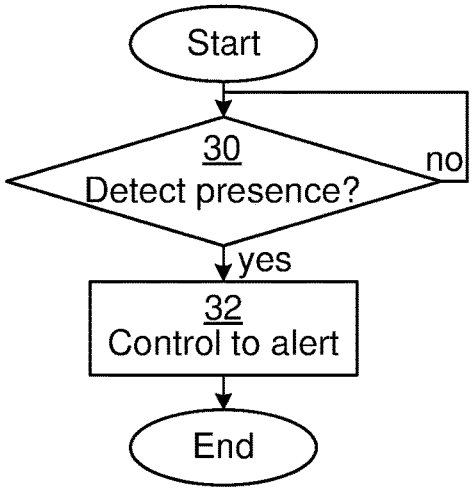
FIGS. 6A-B are flow charts illustrating methods for alerting traffic, performed in the alert control device of FIGS. 1-4.
Figure 6B:
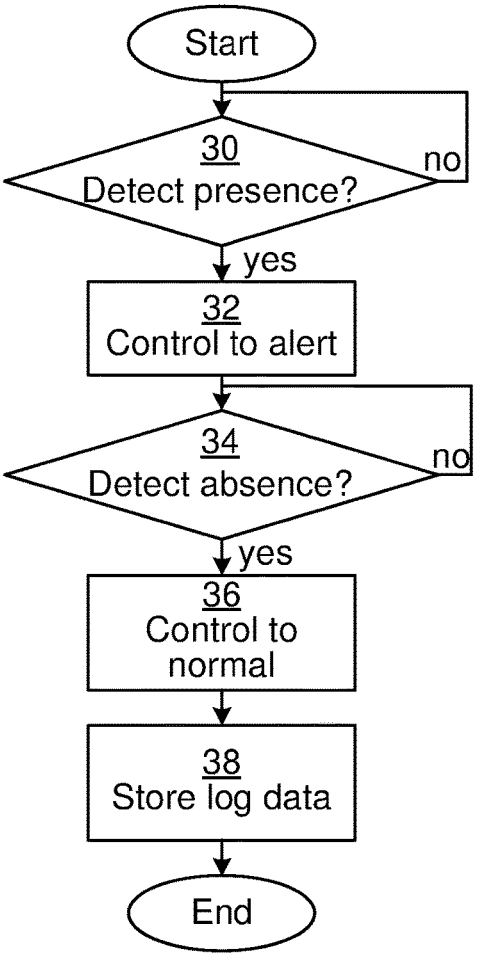

FIGS. 6A-B are flow charts illustrating methods for alerting traffic, performed in the alert control device of FIGS. 1-4. First, the embodiment of FIG. 6A will be described.

In a conditional detect presence step 30, it is checked whether the presence of an RFID device can be detected using an RFID reader. The RFID reader can be part of the alert control device or external to the alert control device but connected to it. If the presence of the RFID device is detected, the method proceeds to a control to alert step 32. Otherwise, the method re-executes the conditional detect presence step 30, optionally after an idle period.

Optionally, only RFID devices having identifiers within a predefined range are considered in the detection. In this way, the detecting can be limited to predefined RFID tags/NFC devices which are associated with alerting traffic by changing the alert state of the street light.

The detecting can e.g. involve detecting, using an NFC reader, the presence of an NFC device comprised in an NFC compliant wireless communication device (2 of FIG. 4). The NFC compliant wireless communication device may then need to be tapped on the NFC reader of the alert control device, which necessitates an action by the user. The user action differentiates users actually intending to cross the road from users which are only by the side of the road but have no intent of crossing the road. This reduces the number of unnecessary alerts due to users being close to the alert control device, whereby the alerts only relate to users with the intent to alert traffic, e.g. for crossing the road or having to go into the road for other reasons.

Alternatively or additionally, the detecting comprises detecting the presence of a battery powered RFID device which is explicitly activated by a user. E.g. using a button on the RFID device. Such activation of the RFID device is another way of a user showing intent to alert traffic.

In the control to alert step 32, the street light connected to the alert control device 1 is controlled to go from the normal state to the alert state as described above with reference to FIGS. 5A-B. As described above, the alert state can involve an altered colour and/or altered light intensity compared to the normal state. The altered light intensity can e.g. be that it is brighter or that the light intensity varies over time, e.g. by blinking.

As explained with reference to FIG. 3 above, the alert control device may optionally be connected to two street lights on either side of the road. The control to alert step 32 of then controls both street lights the same way. This also makes crossing a road safer, since the alert to traffic is even more noticeable.

FIG. 6B is a flow chart illustrating one embodiment of a method for downloading an electronically transferable subscriber identity module. The method of FIG. 6B is similar to the method of FIG. 6A and only steps which are new or modified compared to the method of FIG. 6A are described here. In this embodiment, the absence of an RFID device is handled and also logging is performed.

After the control to alert step 32, there is here a conditional detect absence step 34. In the conditional detect absence step 34, it is checked whether the absence of an RFID device can be detected using the RFID reader. If the absence of the RFID device is detected, the method proceeds to a control to normal step 36. Otherwise, the method re-executes the conditional detect absence step 34, optionally after an idle period.

Optionally, the alert control device only considers the absence of any RFID device to be detected when an absence of any RFID devices is maintained during a configurable time period. In this way, the street light stays in alert mode longer than only when the RFID tag/NFC device is out of range, which can e.g. make it safer for a pedestrian to cross a road as the range of the detecting range of the alert control device may only cover part of the road crossing.

In the control to normal step 36, the street light connected to the alert control device 1 is controlled to go from the alert state to the normal state as described above with reference to FIGS. 5A-B.

In an optional store log data step 38, log data is stored regarding when the street light is controlled to go from the normal state to the alert state, and/or vice versa has occurred. The log data can be stored locally and collected by operators or the alert control device is optionally provided with a wireless communication module, providing the log data to a central server. The log data can be used to analyse patterns of usage, being an indicator of unprotected road user presence.

Figure 7:
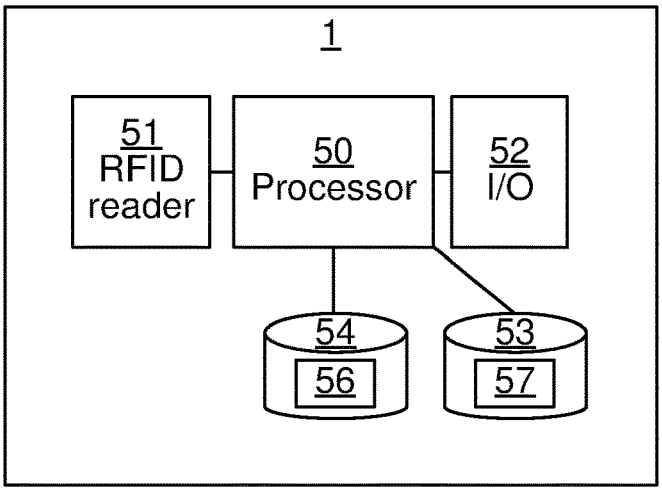
FIG. 7 is a schematic diagram showing some components of the alert control device of FIGS. 1-4.

FIG. 7 is a schematic diagram showing some components of the alert control device of FIGS. 1-4. A processor 50 is provided using any combination of one or more of a suitable central processing unit (CPU), multiprocessor, microcontroller, digital signal processor (DSP), application specific integrated circuit etc., capable of executing software instructions 56 stored in a memory 54, which can thus be a computer program product. The processor 50 can be configured to execute the method described with reference to FIGS. 6A-B above.

The memory 54 can be any combination of read and write memory (RAM) and read only memory (ROM). The memory 54 also comprises persistent storage, which, for example, can be any single one or combination of magnetic memory, optical memory, solid state memory or even remotely mounted memory.

Optionally, the alert control device 1 further comprises an I/O interface 52 for communicating with other entities, such as to control the state of a street light. The I/O interface 52 may also comprise a user interface to allow an operator to control the operation of the alert control device 1.

The alert control device 1 also comprises an RFID reader 51 for detecting the presence of an RFID device, e.g. an RFID tag. Optionally, the RFID reader 51 uses NFC, e.g. complying with ISO/IEC 18092:2013. Optionally, the RFID reader 51 comprises modules for reading both RFID tags and NFC devices, optionally on different frequencies.

A data memory 53 is also provided for reading and/or storing data during execution of software instructions in the processor 50. The data memory 53 can be any combination of read and write memory (RAM) and read only memory (ROM). The data memory 53 here also comprises log data ≡regarding when the street light is controlled to go from the normal state to the alert state, and/or vice versa has occurred.

The alert control device 1 is in contact with at least one street light, where the alert control device 1 can be part of the street light or external to, but connected to the street light.

Other components of the alert control device 1 are omitted in order not to obscure the concepts presented herein.

Figure 8:
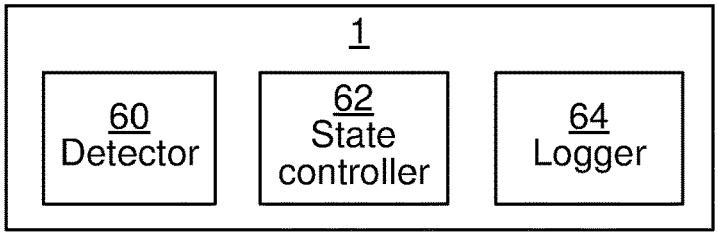
FIG. 8 is a schematic diagram showing functional modules of the alert control device of FIGS. 1-4.

FIG. 8 is a schematic diagram showing functional modules of the alert control device 1 of FIGS. 1-4. The modules can be implemented using software instructions such as a computer program executing in the alert control device 1 and/or using hardware, such as application specific integrated circuits, field programmable gate arrays, discrete logical components, etc. The modules correspond to the steps in the methods illustrated in FIGS. 6A-B.

A detector 60 is arranged to detect a presence of a radio frequency identification device using a radio frequency identification reader. This module corresponds to the detect presence step 30 of FIGS. 6A-B and the detect absence step 34 of FIG. 6B.

A state controller 62 is arranged to control the street light to go from a normal state to an alert state or vice versa. This module corresponds to the control to alert step 32 of FIGS. 6A-B and the control to normal step 36 of FIG. 6B.

A logger 64 is arranged to store log data regarding when the street light is controlled to go from a normal state to an alert state has occurred. This module corresponds to the store log data step 38 of FIG. 6B.

Figure 9:
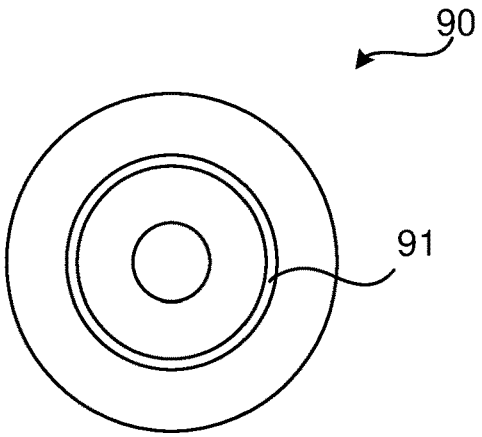
FIG. 9 shows one example of a computer program product comprising computer readable means.

FIG. 9 shows one example of a computer program product 90 comprising computer readable means. On this computer readable means a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as the computer program product 56 of FIG. 7 or e.g. on a USB (Universal Serial Bus) drive (not shown). While the computer program 91 is here schematically shown as a track on the depicted optical disk, the computer program can be stored in any way which is suitable for the computer program product.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method for alerting traffic, the method being performed in an alert control device connected to a street light, the method comprising:

receiving a first signal transmitted by a first device within the possession of a first individual within a proximity of the street light, wherein the first individual is one of a pedestrian and a cyclist, the first signal being received via a near field communication (NFC) technology;

after receiving the first signal, determining that the first individual intends to cross a street within the proximity of the street light; and as a result of determining that the first individual intends to cross the street, controlling the street light to go from a normal state to a first alert state, wherein the lighting of the street light in the first alert state differs from the lighting of the street light in the normal state in order to alert passing vehicles that the first individual may be crossing the street within the proximity of the street light;

receiving a second signal transmitted by a second device within the possession of a second individual;

determining that a NFC signal from the second device has not been received; and based on the receipt of the second signal and the determination that the NFC signal from the second device has not been received, determining that the second individual is within the proximity of the street light but does not intend to cross the street.

2. The method of claim 1, wherein the first alert state involves an altered color compared to the normal state.

3. The method of claim 1, wherein the first alert state involves an altered light intensity compared to the normal state.

4. The method of claim 1, further comprising the steps of:

detecting an absence of any radio frequency identification devices using the alert control device; and controlling the street light to go from the first alert state to the normal state.

5. The method of claim 4, wherein the step of detecting an absence of any radio frequency identification devices comprises detecting an absence of any radio frequency identification devices during a configurable time period.

6. The method of claim 1, wherein the alert control device is connected to two street lights on either side of a road and wherein the step of controlling the street light controls both street lights the same way.

7. The method of claim 1, wherein at least one of the first signal and the second signal is received via a battery powered radio frequency identification device which is activated by a user.

8. The method of claim 1, further comprising the step of:

storing log data regarding when the step of controlling the street light to go from a normal state to the first alert state has occurred.

9. The method of claim 1, wherein the first signal is detectable over a maximum range of approximately 10 centimeters.

10. The method of claim 1, wherein the method further comprises:

as a result of determining that the second individual is within the proximity of the street light but does not intend to cross the street, controlling the street light to enter a second alert state, wherein the lighting of the street light in the second alert state differs from the lighting of the street light in the first alert state.

11. An alert control device for alerting traffic, the alert control device being arranged to be connected to a street light, the alert control device comprising:

a receiver configured to receive a first signal transmitted by a first device within the possession of a first individual within a proximity of the street light, wherein the first individual is one of a pedestrian and a cyclist, the first signal being received via a near field communication (NFC) technology;

a processor; and a memory storing instructions that, when executed by the processor, cause the alert control device to:

determine that the first individual intends to cross a street within the proximity of the street light, said determining being based on the first signal received from the first device within the possession of the first individual;

as a result of determining that the first individual intends to cross the street, control the street light to go from a normal state to a first alert state, wherein the lighting of the street light in the first alert state differs from the lighting of the street light in the normal state in order to alert passing vehicles that the first individual may be crossing the street within the proximity of the street light;

receive a second signal transmitted by a second device within the possession of a second individual;

determine that a NFC signal from the second device has not been received; and based on the receipt of the second signal and the determination that the NFC signal from the second device has not been received, determine that the second individual is within the proximity of the street light but does not intend to cross the street.

12. The alert control device of claim 11, wherein the first alert state involves an altered color compared to the normal state.

13. The alert control device of claim 11, wherein the first alert state involves an altered light intensity compared to the normal state.

14. The alert control device of claim 11, further comprising instructions that, when executed by the processor, causes the alert control device to:

detect an absence of any radio frequency identification devices using the receiver; and control the street light to go from the alert state to the normal state.

15. The alert control device of claim 14, wherein the instructions to detect an absence of any radio frequency identification devices comprise instructions that, when executed by the processor, causes the alert control device to detect an absence of any radio frequency identification devices during a configurable time period.

16. The alert control device of claim 11, wherein the alert control device is connected to two street lights on either side of a road and the alert control device is arranged to control both street lights the same way.

17. The alert control device of claim 11, wherein at least one of the first signal and the second signal is received via a battery powered radio frequency identification device which is activated by a user.

18. The alert control device of claim 11, further comprising instructions that, when executed by the processor, causes the alert control device to:

store log data regarding when the street light is controlled to go from a normal state to the first alert state has occurred.

19. A street light comprising the alert control device of claim 11.

20. A non-transitory computer readable medium on which a computer program comprising computer program code is stored, the computer program code comprising instructions which, when run on an alert control device connected to a street light, cause the alert control device to:

determine that a first individual intends to cross a street within the proximity of the street light, said determining being based on a first signal received from a device within the possession of the first individual, the first signal being received via a near field communication (NFC) technology;

as a result of determining that the first individual intends to cross the street, control the street light to go from a normal state to a first alert state, wherein the lighting of the street light in the first alert state differs from the lighting of the street light in the normal state in order to alert passing vehicles that the first individual may be crossing the street within the proximity of the street light;

receive a second signal transmitted by a second device within the possession of a second individual;

determine that a NFC signal from the second device has not been received; and based on the receipt of the second signal and the determination that the NFC signal from the second device has not been received, determine that the second individual is within the proximity of the street light but does not intend to cross the street.

21. The alert control device of claim 11, wherein the first signal is detectable over a maximum range of approximately 10 centimeters.

22. The alert control device of claim 11, wherein the alert control device is further configured to control the street light to enter a second alert state in response to determining that the second individual is within the proximity of the street light but does not intend to cross the street, wherein the lighting of the street light in the second alert state differs from the lighting of the street light in the first alert state.

23. A method for alerting traffic, the method being performed in an alert control device connected to a street light, the street light having a normal state, a first alert state configured to alert passing vehicles that persons may be crossing the street within a proximity of the street light, the first alert state being further configured to be triggered based on the alert control device receiving one or more near field communication (NFC) signals, and a second alert state, the second alert state differing from the normal state and the first alert state, the method comprising:

receiving a first signal transmitted by a device within the possession of an individual within a proximity of the street light;

determining that an NFC signal from the device has not been received; and based on the receipt of the first signal and the determination that the NFC signal from the device has not been received, determining that the individual is within the proximity of the street light but does not intend to cross the street;

as a result of determining that the individual is within the proximity of the street light but does not intend to cross the street, controlling the street light to enter the second alert state, the second alert state being configured to alert passing vehicles that the individual is within the proximity of the street light but does not intend to cross the street.

* * * * *